US005084938A

United States Patent [19]

Knestele

[11] Patent Number: 5,084,938

[45] Date of Patent: Feb. 4, 1992

[54] APPARATUS FOR CLEANING FLOOR COVERINGS

[76] Inventor: Leopold Knestele, Wengener Strasse 10, D 7954 Haidgau, Fed. Rep. of Germany

[21] Appl. No.: 537,075

[22] Filed: Jun. 13, 1990

[30] Foreign Application Priority Data

Jun. 13, 1989 [DE] Fed. Rep. of Germany ..... 3919271

[51] Int. Cl.[5] ..... A47L 11/284

[52] U.S. Cl. ..... 15/98

[58] Field of Search ..... 15/52, 98, 230, 230.14, 15/230.16, 230.17, 230.18, 230.19, 320

[56] References Cited

U.S. PATENT DOCUMENTS 558,292 4/1896 Lyons et al. ..... 15/244.2

2,289,117 7/1942 Harrison ..... 15/244.1

4,884,310 12/1989 Knestele ..... 15/98

FOREIGN PATENT DOCUMENTS 2633152 1/1978 Fed. Rep. of Germany .

*Primary Examiner*—Edward L. Roberts

*Attorney, Agent, or Firm*—Herbert Dubno

[57] ABSTRACT

An apparatus for cleaning floor coverings is provided. A sponge is disposed in a downwardly open housing and is adapted to be supplied with cleaning liquid. The fine-pored plastic sponge is held in a supporting frame, the underside of which is provided with rectangularly shaped recesses. The sponge is disposed in the supporting frame, for example under preload, in such a way that it projects partially out of the recesses in the form of bulging rolls, and projects beyond the support surface of the housing and/or of the supporting frame.

17 Claims, 3 Drawing Sheets

APPARATUS FOR CLEANING FLOOR COVERINGS

FIELD OF THE INVENTION

The present invention relates to an apparatus for cleaning rugs, wall-to-wall carpets and similar floor coverings, and includes, as a cleaning element, a sponge that is disposed in a downwardly open housing that is provided with a shaft-like handle with the sponge being adapted to be supplied with cleaning liquid.

BACKGROUND OF THE INVENTION

An automobile and window pane cleaning apparatus of this general type is known from German Offenlegungsschrift 26 33 152, where the sponge has a sheet-like configuration. In this connection, the sponge, which is adapted to the internal measurements of the housing, extends beyond the lower, open end of the housing, and is held in the housing via two cylinders that extend through transverse bores formed in the sponge and are supported in mountings disposed on the housing.

Thus, the entire face of the sponge, to which water can be supplied via a hollow post, rests upon the surface that is to be cleaned. Consequently, a good gliding capability is not provided. Occasionally, if too great a pressure is applied, movement cannot be effected. Furthermore, this heretofore known apparatus is not suitable for cleaning rugs, wall-to-wall carpets and similar floor coverings because the sponge cannot be introduced between the loops and the pile of a rug or carpet due to the large support surface. Consequently, dirt cannot be removed from this area.

OBJECTS OF THE INVENTION

It is therefore an object of the present invention to provide an apparatus for cleaning floor coverings that not only has a straight forward construction, and hence is economical to produce, but rather via which it is possible to clean such a floor covering in a short period of time and very thoroughly. In addition, it is an object to provide an apparatus which is easy to handle and in which the sponge is capable of being replaced in a short period of time without difficulty should it become worn.

SUMMARY OF THE INVENTION

The apparatus of the present invention is characterized primarily in that the sponge, which is made of a fine-pored plastic, is held in a supporting frame that has a U-shaped cross-sectional configuration and on the underside of which is provided one or more rectangularly shaped recess that has an axis that extends perpendicular or at an angle to the direction of movement of the apparatus, with the supporting frame preferably being detachably connected to the housing; the sponge, for example under preload, is pressed or placed in the interior of the supporting frame in such a way as to project partially out of the recesses, in the arm of bulgings or rolls, and beyond the support surfaces of the housing, the supporting frame, and/or a support bracket that receives the same.

It is furthermore advantageous to cover the supporting frame, on that side that faces the housing of the cleaning apparatus, with a plate that is preferably placed in or on the housing. The plate is provided with one or more dividing chambers for the cleaning liquid, and is also provided with discharge channels that open out into the interior of the supporting frame. The discharge openings should be formed in the plate in such a way that they are disposed vertically above the recesses of the supporting frame, preferably being distributed uniformly above these recesses.

To enable or enhance the ability of the sponge to emerge from the supporting frame as a bulging tool, it is furthermore suitable to provide the plate, which is preferably embodied in two parts, with convexly curved thicker portions or bulges on that side faces the sponge, these thicker portions should be disposed in the vicinity of the recesses of the supporting frame and should extend parallel thereto. In addition, for the same purpose, those edge regions of the recesses of the supporting frame that extend perpendicular to the direction of movement of the cleaning apparatus should have a concavely curved configuration and/or be provided with concavely curved rims or shoulders that preferably project inwardly.

The sponge can be fixed in the supporting frame by means of pins or dogs that extend into the sponge and are mounted on the supporting frame and/or on the plate, via the rims or shoulders that are provided in the edge regions of the recesses, via an adhesive strip, or in similar manner. The supporting frame can also be detachably connected with the housing via tightening screws, latching dogs, etc.

Pursuant to a further specific embodiment of the present invention, it is advantageous to resiliently support the housing that accommodates the supporting frame in a support bracket via springs, elastic bands, etc., and to oscillatingly drive the housing in a horizontal plane via a motor that is provided on the support bracket and has an eccentric. It if furthermore advantageous to provide the support bracket with laterally mounted guide runners, guide surfaces, etc., which extend in the direction of movement of the cleaning apparatus and should be provided with cleats, grooves, or the like that extend in the direction of movement of the cleaning apparatus.

A straight forward handling results if the handle of the cleaning apparatus is pivotably secured to the support bracket directly over the glide surfaces.

A cleaning apparatus embodied pursuant to the present invention insures that a rug or carpet can be cleaned very thoroughly in a short period of time. This is so because the rolls of the sponge that are pressed out of the recesses of the supporting frame loosen and take up the particles of dirt that are found between the loops and the piles of the floor covering, so that especially if a cleaning liquid can be used, an intensive cleaning is achieved. Since the apparatus is supported on the floor covering above the housing and/or the support bracket, and only the rolls of the sponge rest upon the floor covering, a light and always uniform pressure results in good sliding or gliding characteristics. The apparatus is economical to produce because it is composed of only a few parts that can be produced without difficulty. Furthermore, as an expendable part, the sponge can be quickly replaced. Thus, the inventive apparatus, while being easy to handle, allows an extremely good cleaning of a floor covering to be accomplished.

BRIEF DESCRIPTION OF THE DRAWING

These and other objects and advantages of the present invention will appear more clearly from the following specific description in conjunction with the accompanying schematic drawing, in which.

SPECIFIC DESCRIPTION

Figure 1:
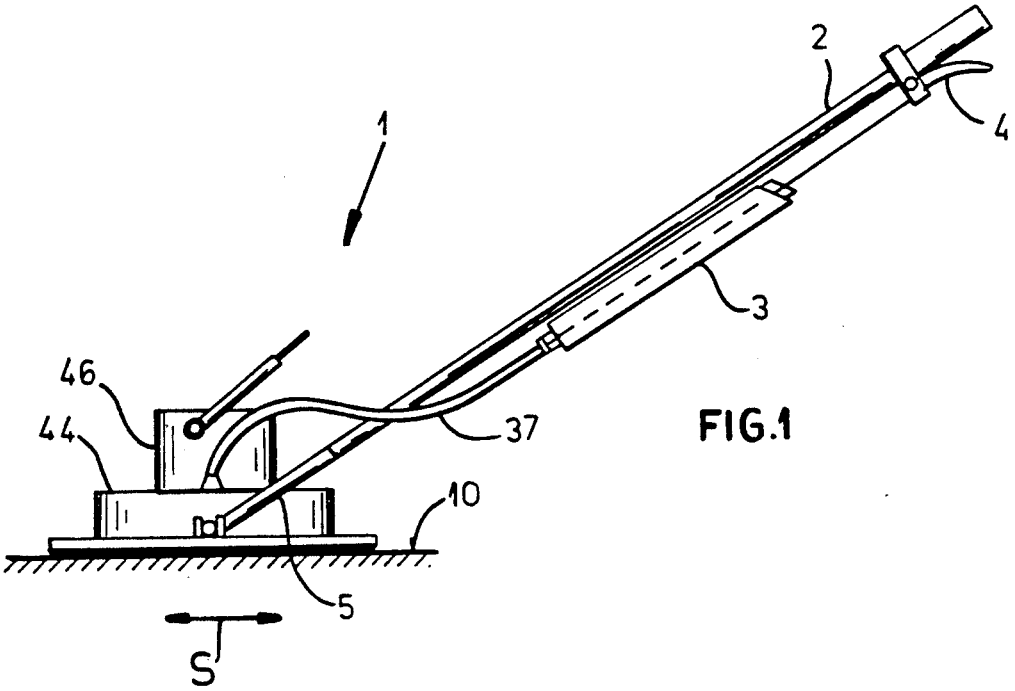
FIG. 1 is a side view of one embodiment of the apparatus of the invention for cleaning floor coverings.

The apparatus 1 illustrated in FIG. 1 is intended for cleaning rugs, carpets and similar floor coverings 10. For this purpose, the apparatus 1 is moved over the surface that is to be cleaned in the direction of the arrow S with the aid of a handle 2 that is embodied as a post or shaft. In this connection, the handle 2 is connected to a support bracket 44 via a pivot member or bracket 5, as can be seen in detail from FIG. 6. The handle 2 is also provided with a supply tank 3 for a cleaning liquid; the non-illustrated discharge valve of the supply tank 3 is actuatable via a lever 4 that is similarly mounted on the handle 2.

In all of the embodiments, the cleaning liquid can be fed to a fine-pored plastic sponge 14 or 34 that is pressed into the interior 13 or 33 of a supporting frame 12, 12' or 32, 32', which in the direction of movement S has a U-shaped cross-sectional configuration. Formed in the base of the supporting frame 12, 12' or 32, 32' are two recesses 21 or 41 that extend parallel to one another, with the axes of the recesses extending perpendicular to the direction of movement S. Disposed on the sponge 14, 34 is a plate 15, 15' or 35, 35', which can also have a two-part construction, so that the sponge 14 or 34 protrudes from the recesses 21 or 41 in the form of bulges or rolls 14' or 34'. Each of the plates 15, 15' or 35, 35' is provided with a collection chamber 16, 16' or 36 that is connected to the supply tank 3 via a feed means or line 17, 17' or 37, and is connected to the sponge 14 or 34 via channel 18 or 38.

Figure 2:
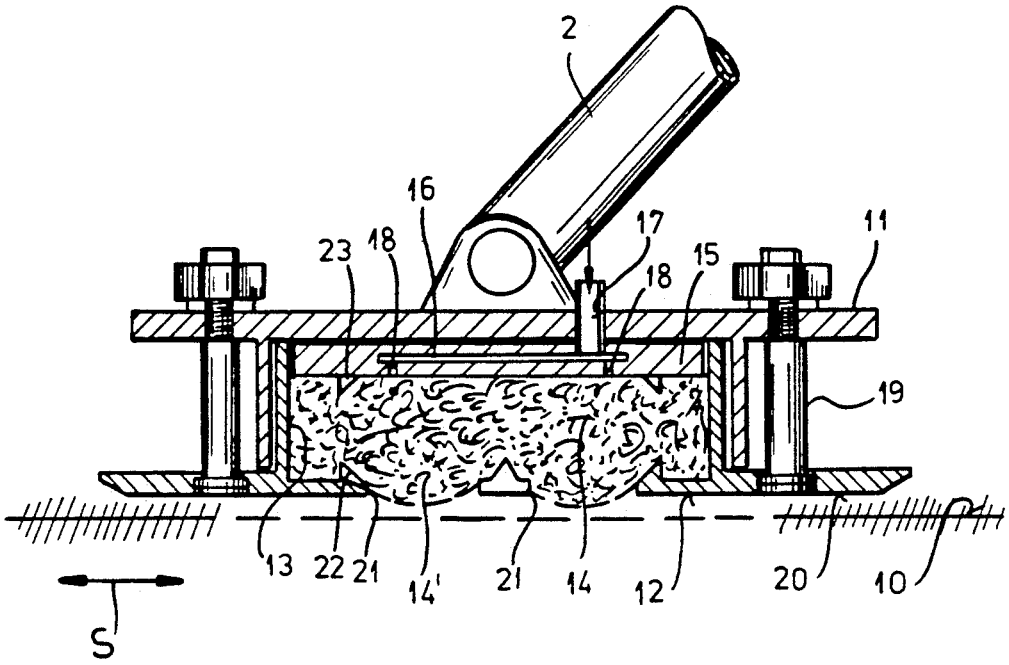
FIG. 2 is an axial cross-sectional view through the supporting frame of the apparatus of FIG. 1, with this supporting frame accommodating the sponge and being held in a housing.
Figure 3:
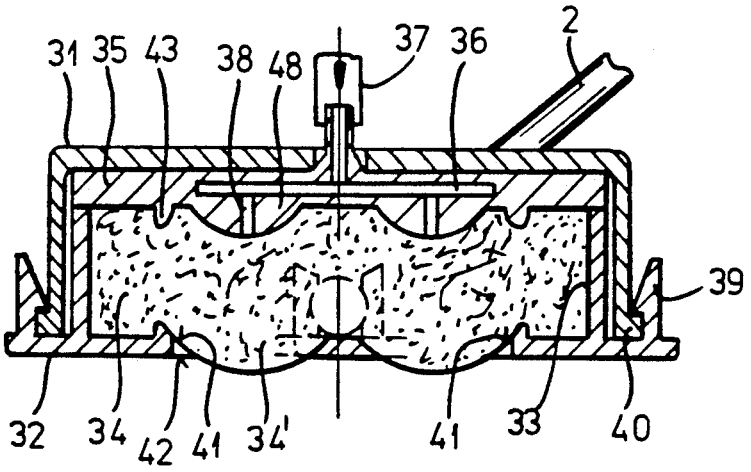
FIG. 3 is an axial cross-sectional view of a different embodiment of the supporting frame and housing.

The supporting frame 12, 12' or 32, 32' is detachably connected with a housing 11, 11' or 31, 31'. For this purpose, as shown in FIG. 2, tightening screws 19 can be provided that are braced against the housing 11 and the supporting frame 12. However, as shown in FIGS. 3 and 5, it is also possible to provide detents 39, 39' on the supporting frame 32, 32' that cooperate with the interlocking means 40 or recesses 40' of the housing 31 or 31'. These connection elements are not indicated by reference numerals in the embodiment of FIG. 4.

Figure 4:
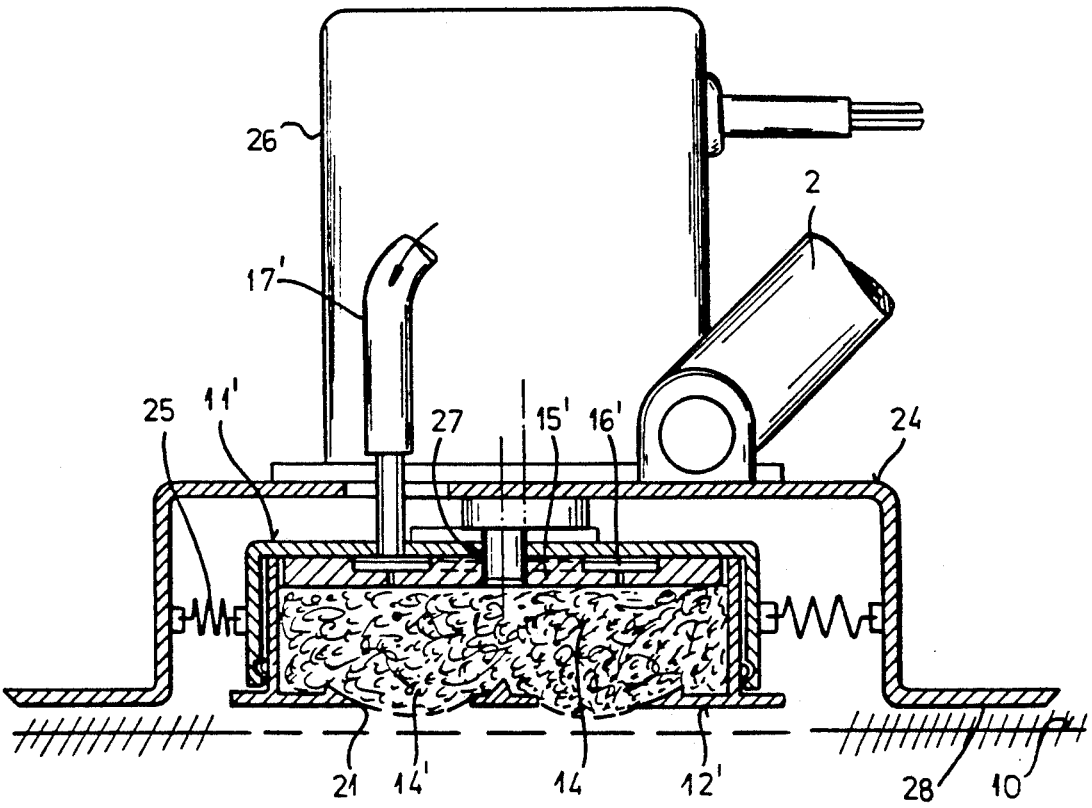
FIGS. 4 and 5 are axial cross-sectional views of modified embodiments of the housing of FIGS. 2 and 3 that is supported in a support bracket and is driven in an oscillating manner by a motor.
Figure 5:
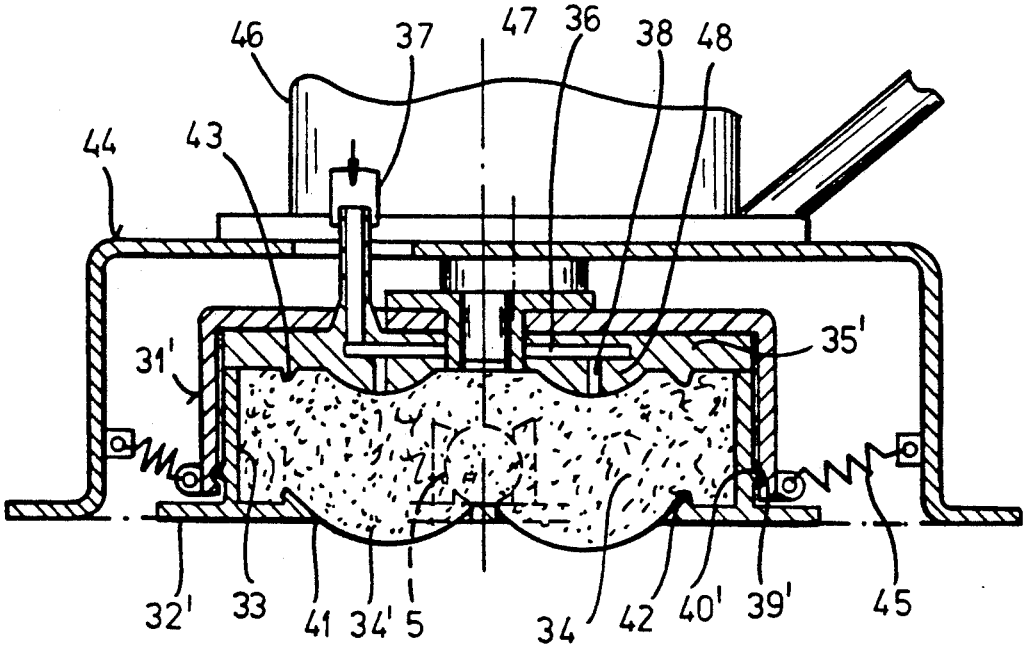

As shown in FIGS. 4 and 5, the housings 11' or 31' are supported in a support bracket 24 or 44 via springs 25 or 45 in such a way that they can be swiveled or oscillated in an approximately horizontal plane. The housings 11' and 31' are driven by a motor 26 or 46 respectively. For this purpose, the motor 26 or 46 is equipped with an eccentric 27 or 47 that acts upon the housing 11' or 31' and/or upon the plate 15' or 35'. By means of the oscillating movement of the sponge 14 or 34, accompanied by the supply of a cleaning liquid, a particularly intensive cleaning of the floor covering 10 is achieved via the rolls 14' or 34' of the sponge.

The sponge 14 or 34 is pressed into the interior 13 or 33 of the supporting frame 12, 12' or 32, 32' with such a preload that the rolls 14' or 34' are pressed out through the recesses 21 or 41 and beyond the support surfaces 20 or 28 that are provided on the supporting frame 12 or the support bracket 24, and that form a plane. To enhance this effect, those edge regions of the recesses 21 and 41 that extend parallel to the direction of movement S are provided with concavely curved rims or shoulders 22 and 42 respectively. In addition, pursuant to the embodiments illustrated in FIGS. 3 and 5, convexly curved thicker portions 48 can be formed on the plate 35 or 35' above the recesses 41. The sponge 34 is similarly pressed out of the recesses 41 by means of these thicker portions 48. With this embodiment, it is also possible to insert the sponge 34 into the supporting frame 32 without preload.

Figure 6:
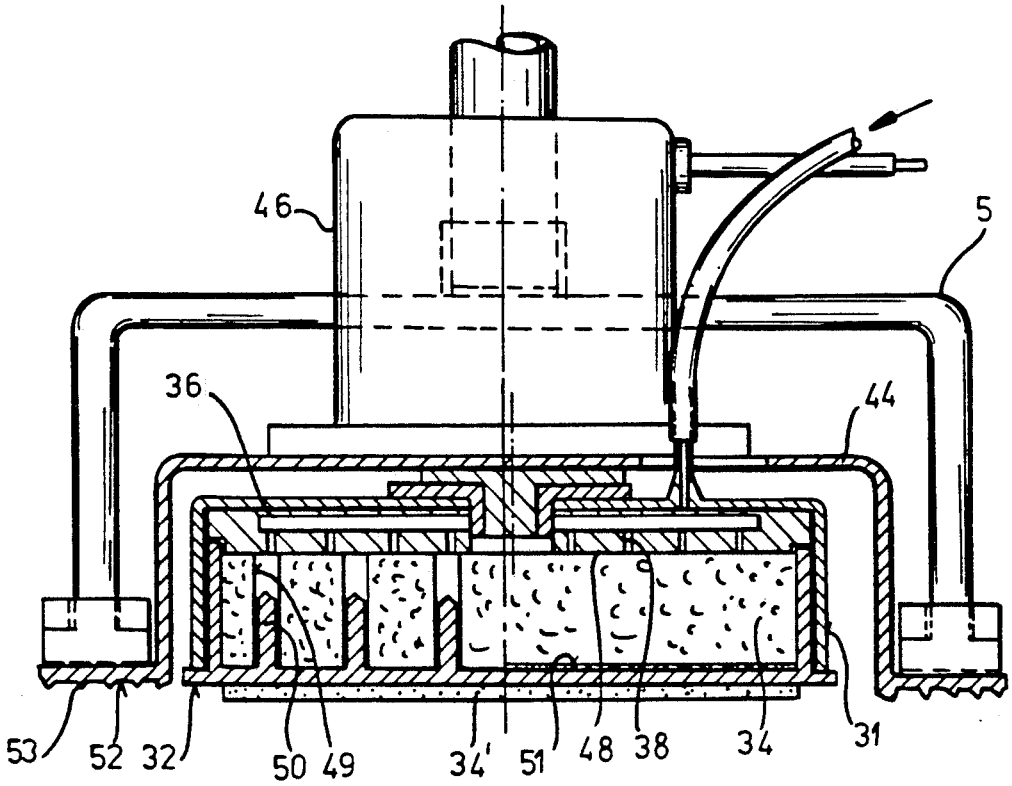
FIG. 6 is an axial cross-sectional view of the apparatus of FIG. 5, but turned by 90°.

As shown in the left half of FIG. 6, in order to hold the sponge 14 or 34 in the interior 13 or 33 of the supporting frame 12 or 32, upwardly projecting pins 50 are provided on the base of the supporting frame 32; these pins 50 extend into holes 49 formed in the sponge 34. However, as shown in the right half of FIG. 6, it is also possible to fix the sponge in position by means of an adhesive strip 51. For the same purpose, it would, however, also be possible to form on the plate 15 or 35, 35' dogs 23 or 43 that project therefrom and that, as do the rims 42, extend into the sponge 14 or 34 to thereby fix the same (see FIGS. 2-5).

As shown in FIG. 6, so that during movement the cleaning apparatus 1 is also guided laterally, a number of glide cleats 53 are formed on the glide surfaces 52 of the support bracket 44, with these glide surfaces extending in the direction of movement S. Thus, the cleaning apparatus 1 is supported in a nearly shake-free manner, even when the sponge 34 is driven in such a way as to oscillate.

The present invention is, of course, in no way restricted to the specific disclosure of the specification and drawings, but also encompasses any modifications within the scope of the appended claims.

What I claim is:

1. In an apparatus for cleaning rugs, wall-to-wall carpets, and similar floor coverings, and including, as a cleaning element, a sponge that is disposed in a downwardly open housing that is provided with a shaft-like handle, with said sponge being adapted to be supplied with cleaning liquid, the improvement wherein:

said sponge is made of a fine-pore plastic; and a supporting frame in said housing is provided that has a U-shaped cross-sectional configuration and in which said sponge is held, with said supporting frame and said housing having an underside provided with supporting surfaces for placement adjacent said floor covering, at least one rectangularly shaped recess formed in said underside of said supporting frame and having an axis that extends perpendicular to or at an angle to a direction of movement of said apparatus, said recess being open toward a floor covering inwardly of said support surfaces of said housing and supporting frame said sponge being disposed in the interior of said supporting frame and projecting partially out of said recess, in the form of bulging rolls, and beyond said support surfaces of said housing and supporting frame.

2. An apparatus according to claim 1, in which said supporting frame is detachably connected with said housing.

3. An apparatus according to claim 1, in which said sponge is disposed under preload in the interior of said supporting frame.

4. An apparatus according to claim 1, wherein said housing includes a support bracket that receives said supporting frame.

5. An apparatus according to claim 1, which includes a plate that covers said supporting frame on a side thereof that faces said housing and is remote from said floor covering, with said plate being provided with at least one chamber for cleaning liquid and also being provided with discharge channels that open out into the interior of said supporting frame.

6. An apparatus according to claim 5, in which said discharge channels of said plate are disposed vertically over said recess of said supporting frame.

7. An apparatus according to claim 6, in which said discharge channels are uniformly distributed over said recess.

8. An apparatus according to claim 5, in which said plate, on a side facing said sponge, is provided with convexly curved thicker portions that are disposed in the vicinity of said recess of said supporting frame and extend parallel thereto.

9. An apparatus according to claim 5, in which edge regions of said recess of said supporting frame that extend perpendicular to said direction of movement of said apparatus are concavely curved.

10. An apparatus according to claim 9, in which said edge regions are provided with concavely curved shoulders that project inwardly.

11. An apparatus according to claim 10, in which said sponge is fixed in said supporting frame via said shoulders of said edge regions of said recesses.

12. An apparatus according to claim 5, in which said sponge is fixed in said supporting frame via an adhesive strip.

13. An apparatus according to claim 5, in which said sponge is fixed in said supporting frame via pins or dogs that extend into said sponge and are disposed on said supporting frame and/or on said plate.

14. An apparatus according to claim 1, in which said housing receives said supporting frame and is resiliently supported in a support bracket via elastic means; and which includes a motor that is disposed on said support bracket and is provided with an eccentric, with said motor driving said housing in such a way as to oscillate said housing in a horizontal plane.

15. An apparatus according to claim 14, in which said support bracket is provided with laterally mounted guide surface means that extend in the direction of movement of said apparatus.

16. An apparatus according to claim 15, in which said guide surface means are provided with raised or recessed means that extend in the direction of movement of said apparatus.

17. An apparatus according to claim 15, in which said handle of said apparatus is pivotably secured to said support bracket directly above said guide surface means.

* * * * *